US006105333A

United States Patent [19]

Meesemaecker et al.

[11] Patent Number: 6,105,333

[45] Date of Patent: Aug. 22, 2000

[54] DEVICE FOR FIXING A MOVABLE WINDOW PANE ON A WINDOW REGULATOR OF A MOTOR VEHICLE

[75] Inventors: Thierry Meesemaecker, Ymeray/Frankreich; Manfred Stenzel, Bamberg; Georg Scheck, Weltramdorf; Roland Feder, Weitramsdorf, all of Germany

[73] Assignee: Brose Fahrzeugteile GmbH & Co. KG Coburg, Coburg, Germany

[21] Appl. No.: 09/061,600

[22] Filed: Apr. 16, 1998

[30] Foreign Application Priority Data

Apr. 17, 1997 [DE] Germany ..... 197 16 065

[51] Int. Cl.[7] ..... E06B 3/54

[52] U.S. Cl. ..... 52/716.8; 52/204.64; 52/204.66; 52/204.69; 52/716.7

[58] Field of Search ..... 52/204.64, 204.66, 52/204.69, 204.7, 716.7, 716.8; 296/146.2, 146.16, 201

[56] References Cited

U.S. PATENT DOCUMENTS

| | | | |
|---|---|---|---|
| 4,026,088 | 5/1977 | Akabane | 52/716.8 X |
| 4,105,814 | 8/1978 | Eggert | 52/716.8 X |
| 5,713,167 | 2/1998 | Durham et al. | 52/204.7 X |
| 5,758,459 | 6/1998 | Koike et al. | 52/204.7 X |

FOREIGN PATENT DOCUMENTS

| | | |
|---|---|---|
| 0467645 | 1/1992 | European Pat. Off. . |
| 3108244 | 6/1982 | Germany . |
| 4426670 | 2/1996 | Germany . |
| 4433052 | 3/1996 | Germany . |
| 6-135228 | 5/1994 | Japan . |

*Primary Examiner*—Christopher T. Kent
*Attorney, Agent, or Firm*—Christie, Parker & Hale, LLP

[57] ABSTRACT

A device for blind mounting of window panes can be designed optionally as a friction locking or positive-locking fixing variation.

The device for fixing a movable window pane on a window regulator of a motor vehicle preferably has a substantially U-shaped base member which is open for inserting the edge area of the window pane. Side arms, with a first side arm, of the device are connected together through a base, as well as with at least one locking element mounted displaceable and/or swivelling. When the window pane is inserted in a gap of the base member, the locking element is supported on one side with the first side arm and on the other side with a side face of the window pane. The locking element is mounted resiliently against the insert direction of the window pane and/or across the plane of the window pane wherein a displacement and/or swivel movement carried out in the direction of the spring force reduces the gap of the base member, or with the window pane inserted, increases the pressure of the locking element on the window pane.

26 Claims, 7 Drawing Sheets

DEVICE FOR FIXING A MOVABLE WINDOW PANE ON A WINDOW REGULATOR OF A MOTOR VEHICLE

CROSS REFERENCE TO RELATED APPLICATIONS

This application claims priority of German Application No. 197 16 065.4 filed on Apr. 17, 1997, the disclosure of which is included by reference herein and a copy of which is attached hereto.

BACKGROUND OF THE INVENTION

The invention relates to a device for fixing a movable window pane on a window regulator of a motor vehicle and is suitable for so-called blind assembly.

From DE 31 08 244 A1 a coupling device is known between a pane lifter and a window pane of a motor vehicle which basically comprises a holding element fixed on the lower edge of the window pane and at least one coupling jaw which is equipped with detent means and projects in the direction of a coupling element which is provided with complementary detent elements and is connected to the window regulator mechanism. When bringing together the parts which are to be connected there is an elastic deformation of at least one of the coupling elements until the clip-fit connection is produced by positive interengagement of the detent means.

There is the drawback however that in order to produce the connection between the window pane and window regulator the spreading area must have a minimum elasticity so that the detent elements can enter into positive engagement.

This elasticity also creates the danger that with severe stresses, as may occur for example when a window pane is frozen on the frame, the detent elements may come out of engagement again. The window regulator device could then no longer fulfill its function. Furthermore it is difficult to bring the detent elements precisely into position relative to each other where they stand opposite one another so as to snap fit with each other. It is therefore often necessary to slide the window pane to and fro in the X or vehicle longitudinal axis direction in order to achieve a positive lock.

From JP 6-135228A a device is known for connecting a window pane to a window regulator which uses U-shaped profiled members on the window regulator extending parallel to the lower edge of the pane wherein the free arms of the U profile have inwardly directed hook-like projections. These profiled members are associated with complementary coupling members which can engage in the U-shaped hollow cavity and which are fixed on the lower edge of the window pane. In order to facilitate engagement the free ends of the coupling members are formed wedge-shaped with the barb-like projections being able to engage behind the projections of the U profile. Nevertheless it is generally necessary for the worker to exert pressure on the window pane in the assembly direction in order to produce the necessary keyed engagement. The position between the window regulator and window pane is fixed by means of screws corresponding to the holes and grooves provided. An adjustment of the window pane in the X-direction (vehicle longitudinal axis) for the purpose of setting an ideal position is no more possible than with the embodiment first described.

A fixing device with a substantially U-shaped base member is known from DE 44 26 670-A1. A variation of the embodiment for blind assembly uses a spring clasp engaging round the base member and having an elbow lever mounted thereon for articulated movement as the tension element. The free end of the elbow lever engages in the non-tensioned state through a recess of one of the arms into the gap of the U-shaped base member. On inserting the window pane into the gap between the clamping jaws (arms) the lower edge of the pane enters into engagement with the free end of the elbow lever and is swivelled with further insertion of the window pane over the dead point of the tension system in order then to snap automatically into the stable tension state. The spring clasp which is now tensioned presses the arms of the U-shaped base member against the surface of the window pane in order to fix this with clamping action (i.e. with friction engagement).

The drawback here, however, is that the clamping forces which can be produced with the solution described are not sufficient in each case to withstand the withdrawal forces which actually occur. On the other hand the maximum clamping forces permanently exist which produces high permanent strain on all the parts lying in the force flow. Furthermore the production of the clamping force required over the lower edge of the pane is not without problems since high mechanical strains can lead to breakage of the pretensioned vehicle panes.

SUMMARY OF THE INVENTION

The object of the present invention is to develop a functionally reliable device of simple construction for the blind fitting of a movable window pane on a window regulator of a motor vehicle which is also suitable for fixing both compound glass panes and plastic panes.

Starting from an open and preferably substantially U-shaped base member, the edge of the window pane to be fixed is inserted between two side arms which are connected together by a base. At least one displaceable and/or swivel mounted locking element is supported, when a window pane is inserted in a gap of the base member, on one side by one of the side arms and on another side by a side face of the window pane. The locking element is mounted resilient against the insert direction of the window pane, thus in the withdrawal direction of the window pane, and/or across the plane of the window pane. A displacement and/or swivel movement of the locking element carried out in the direction of the spring force reduces the gap between the arms of the base member and, with the window pane inserted, increases the pressure of the locking element on the window pane. The invention can be designed optionally as a friction-locking or keyed-locking fixing device. When using micro teeth elements the fixing element can have both features of the friction locking engagement and of the keyed locking engagement.

According to a preferred embodiment of the invention the gap of the base member which is formed between the window pane and support face of the locking element on the arm of the base member tapers conically in the withdrawal direction of the window pane. A wedge or roller like, e.g., cylindrical locking element is mounted in the conical gap and is pretensioned spring elastically in the direction of the narrowing gap, thus in the withdrawal direction of the window pane. During insertion of the edge of the window pane in the gap between the arms of the base member the locking element is pressed away from the edge of the pane against the spring tension until the gap in the area of the locking element has exceeded the pane thickness and is thus suitable for receiving the edge of the pane.

If an angle $\alpha$ of the conical gap, in which the locking element is mounted spring-elastically pretensioned, readily conforms with the friction value, then only a comparatively small spring force is required to ensure a secure hold of the window pane in the fixing device even if only friction-locking means are provided to connect the window pane and window regulator. If the designated angle $\alpha$ is at most twice as large as the friction angle $\zeta$=arc tan $\mu$ (with $\mu$=friction value) then a self-strengthening effect occurs which with rising withdrawal force of the window pane leads to increasing clamping force.

The use of this self-strengthening effect makes it possible to use a very small pretensioning force of the spring which loads the locking element in the direction of the window pane. Since the window pane is mainly located in the lowermost position, thus in the position pushed furthest into the base member of the fixing device, the locking element exerts a correspondingly small pressure force on the window pane. The force is only so large that the functional interaction between the locking element and window pane is always guaranteed. The pretensioning force thus lies widely below the force which was necessary to compensate the estimated maximum withdrawal force of the window pane. Thus nothing stands in the way of using this device which is based on the clamping principle for comparatively sensitive plastic panes or compound glass panes. There is no fear of the pressure-sensitive materials flowing away because of overstrain.

Apart from the friction-engaging locking elements it is also possible to use positive-locking fixing variations if suitable positive-locking elements are mounted on the fastening area of the window pane. This can happen, for example, where a separate part bearing the positive-locking elements is fixedly connected to the window pane, e.g., is stuck on or pushed into a hole in the pane. Good adhesion is however also possible through a part which is only placed on the surface of the pane if its material forms good friction match with the surface of the pane or can produce a suitably adhesive bonding. Furthermore molding such positive-locking elements into the glass body itself is also possible. Positive-locking elements of low depth, in the sense of mini-teeth, can also be produced by screen printing. After burning in the printed-on material a sufficient mechanical strength is produced.

The positive-locking elements on the side of the pane are associated with complementary positive-locking elements of the locking element. This locking element can be formed as a slider or as a swivel element mounted on an arm of the base member. A separate spring or a spring connected integral with the locking element ensures that the positive-locking elements are pressed spring-elastically into each other. The contour of the positive-locking elements is preferably of sawtooth shape wherein the steep tooth flanks of the positive-locking elements on the pane side point in the withdrawal direction of the window pane. It is thereby ensured that on the one hand a high holding force is produced and on the other hand however problem-free insertion of the window pane into the gap of the base member can be guaranteed.

BRIEF DESCRIPTION OF THE DRAWINGS

The invention will now be explained in further detail with reference to the embodiments shown in the drawings in which.

DETAILED DESCRIPTION OF THE INVENTION

Figure 1:
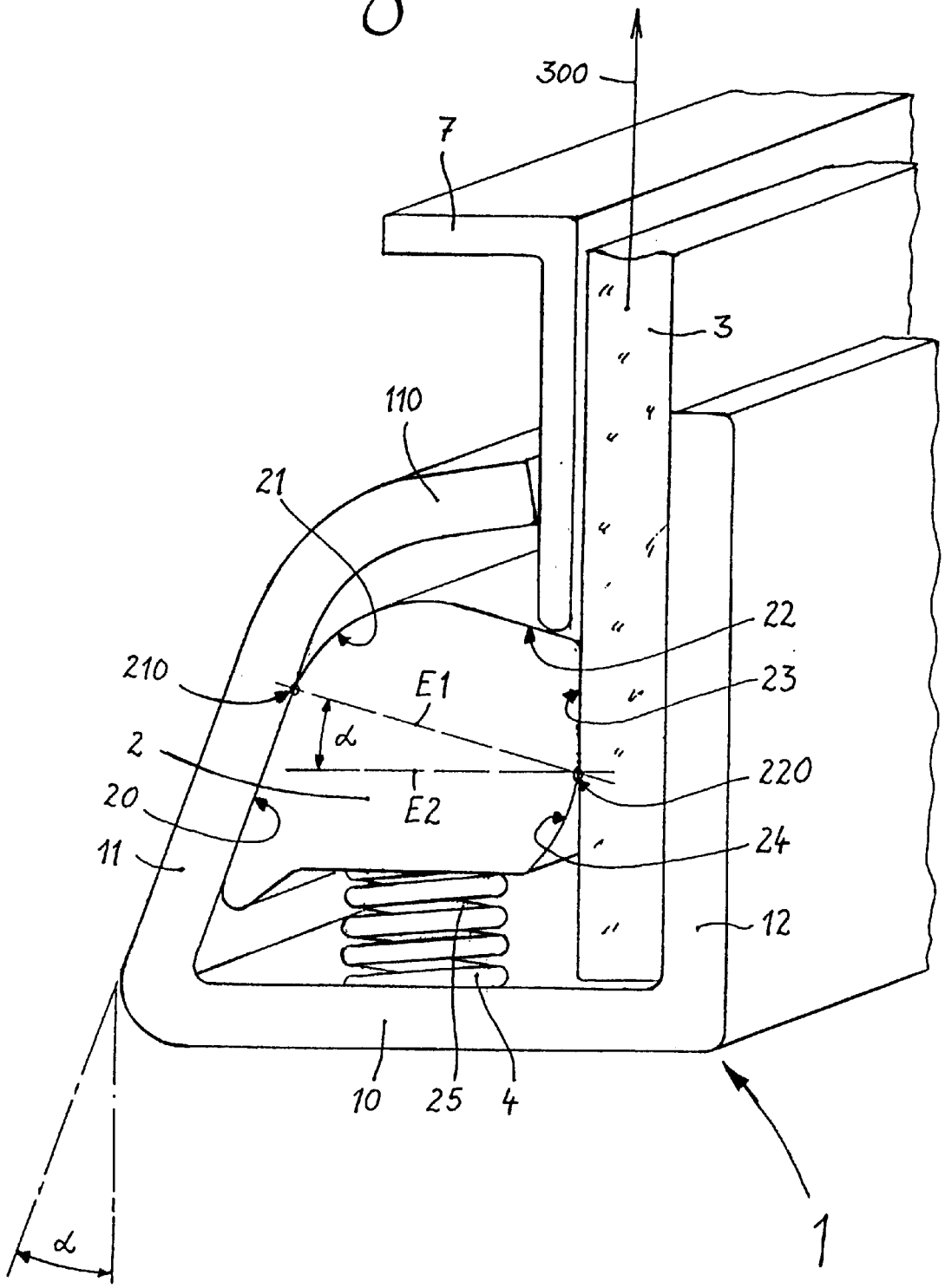
FIG. 1 is a diagrammatic perspective view of a fixing device with a locking element in the form of a displaceable roller body.

The embodiment illustrated in FIG. 1 is a clamping fixing device functioning solely with friction engagement. Its base member 1 is preferably formed from a metal profile whose base 10 supports two arms 11 and 12 at the side. While the one arm 12 runs parallel to the window pane 3 and in direct contact therewith the other arm 11 is inclined by an angle $\alpha$ so that a conically narrowing gap is formed. An angled free end 110 narrows the gap further until the gap width from the arm 12 is a little more than the thickness of the window pane 3 and the angled free end forms at the same time the upper stop for the locking element 2.

At this point it should be pointed out that the illustrated FIGS. 1 to 10 do not show any means which are aimed at making it easier to inset the window pane 3 into the gap of the base member 1, 1*a*, 1*b*, 1*c*, 1*d*, 1*e*, 1*f*, 1*g*, 1*h*, 1*j*. Suitable means here are, for example, insert cones which open upwardly and which are preferably formed in one piece on the base member 1, 1*a*, 1*b*, 1*c*, 1*d*, 1*e*, 1*f*, 1*g*, 1*h*, 1*j*.

Before inserting the window pane 3 into the base member 1 of the fixing device, the locking element 2 is in engagement with the inner face of the angled free end 110 of the arm 11 wherein the gap from the opposite arm 12 to the locking element is reduced to a width which is less than the thickness of the window pane 3. Thus the lower edge of the window pane 3 first strikes the upper face 22 of the locking element 2 and presses this against the tension force of the spring 4 until the gap is sufficiently wide to receive the window pane 3. In order to unlock the window pane 3, e.g., for the purpose of replacing same, pressure is applied in an analogous way with an unlocking tool 7 over the surface 22 onto the locking element 2 whereby the gap between the locking element 2 and arm 12 widens so that the window pane 3 can be removed readily without problem.

The locking element 2 is both a slider and rolling body. With its flat contact bearing faces 20, 23 the locking element 2 functions as a slider if it is a question of compensating the manufacturing tolerances of the base member 1, locking element 2 and window pane 3 through a setting movement of the locking element 2 to be initiated by the spring 4 in the withdrawal direction 300 of the window pane 3. The flat faces 20, 23 rise up from the arm 11 or window pane 3 in the release lines (or clamping lines) 210, 220 and run into convex curved faces 21 and 24, respectively. If now the window pane 3 is drawn out slightly from the base member 1 as a result of a withdrawal force acting on same in the withdrawal direction 300 (as the base member 1 is lowered) then the locking element 2 functions as a rolling body. Lifting up the window pane 3 causes a rotary movement of the locking element 2 counterclockwise. The locking element 2 thereby passes into the area of the conical gap which is becoming narrower and thus correspondingly the holding forces of the fixing device are increased. Even during the next lift of the window pane 3 the latter passes again into the lowermost position so that no noticeable tension forces stress the fixing device or window pane 3.

Also during the rolling movement of the locking element 2 the clamping lines 210, 220 which "wander" in dependence on the rolling angle on the convex faces always lie in a constant relative position. That is, as a result of the conical gap, caused by the inclined arm 11, the clamping line 210 always lies above the clamping line 220 and the inclined angle $\alpha$ between the plane E1 containing the clamping lines 210 and 220 and the plane E2 running orthogonal to the plane of the pane does not change during rolling movement of the locking element 2. The angle $\alpha$ depends on the friction conditions of the parts involved. The boundary angle can be calculated as follows:

$$\alpha \leqq 2 \text{ arc tan } \mu \ (\mu\text{=friction value})$$

The contours of the convex faces 21, 24 can be a component part of a circle; they can, however, also have a contour deviating from same in order to adapt the clamping forces to a changing geometry inside the conical clamping gap (e.g. as a result of the bending up of the arm 11 or as a result of changing friction conditions through changed surface pressure).

A stud 25 is molded onto the underneath of the locking element 2 for positioning the coil spring 4. Naturally other types of springs can also be used according to choice. It is only important that there is a sufficiently large force component of the spring 4 in the withdrawal direction 300.

Figure 2:
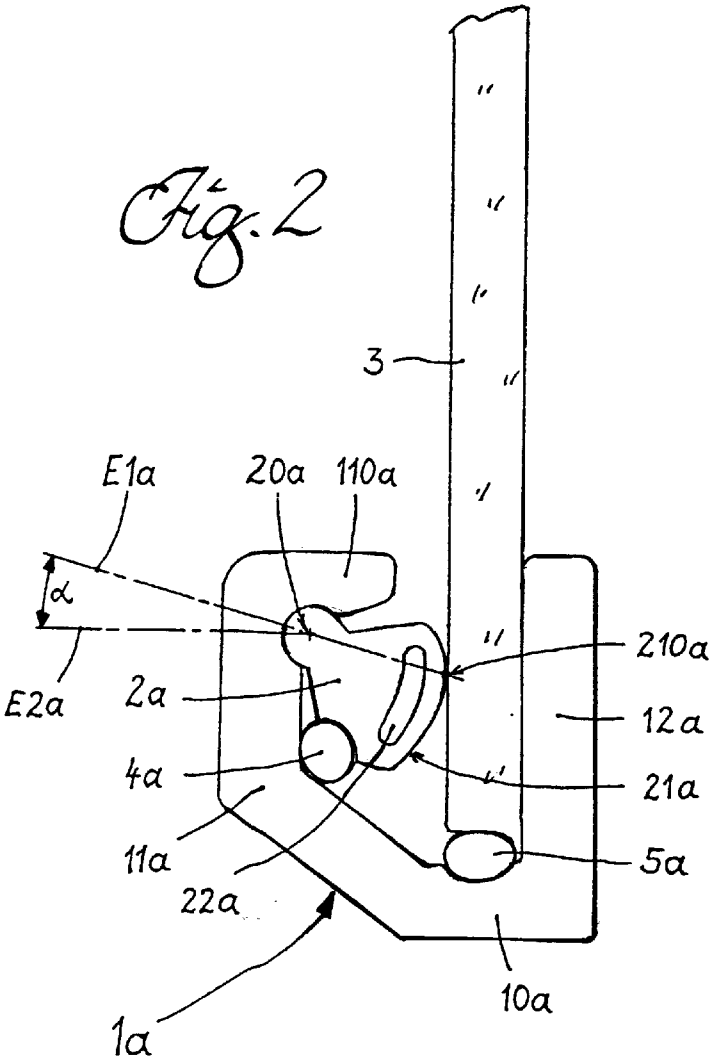
FIG. 2 is a diagrammatic view of the cross section through a fixing device with a clamping body with elastic clamping face swivel mounted in the arm of the base member.

Also the design variation of FIG. 2 is based on the sole use of the friction locking engagement. The locking element 2*a* is formed as a swivel element and is mounted on the upper end of the arm 11*a* of the base member 1*a*. Its clamping face 21*a* is curved convex and is formed resilient through an elastic area 22*a*. The contour of the clamping face 21*a* is, starting from the swivel axis 20*a*, spaced increasingly distant as the locking element turns counterclockwise, so that movement of the clamping face 21*a* in the withdrawal direction 300 of the window pane 3 ensures increasing clamping force. The necessary contact pressure of the clamping face 21*a* against the surface of the window pane 3 is produced by a spring element 4*a* which is supported on the arm 11*a*. If the locking element 2*a* is an injection molded plastic part, then the spring element 4*a* can be injection molded advantageously in the so-called twin-component technique. A further spring element 5*a* (possibly made of elastomer) is mounted between the base 10*a* and the lower edge of the window pane (3). Spring element 5*a* ensures a low degree of canting or tilting of the window pane, where the locking element 2*a* would already be swivelled slightly counterclockwise, is constantly maintained.

Figure 3:
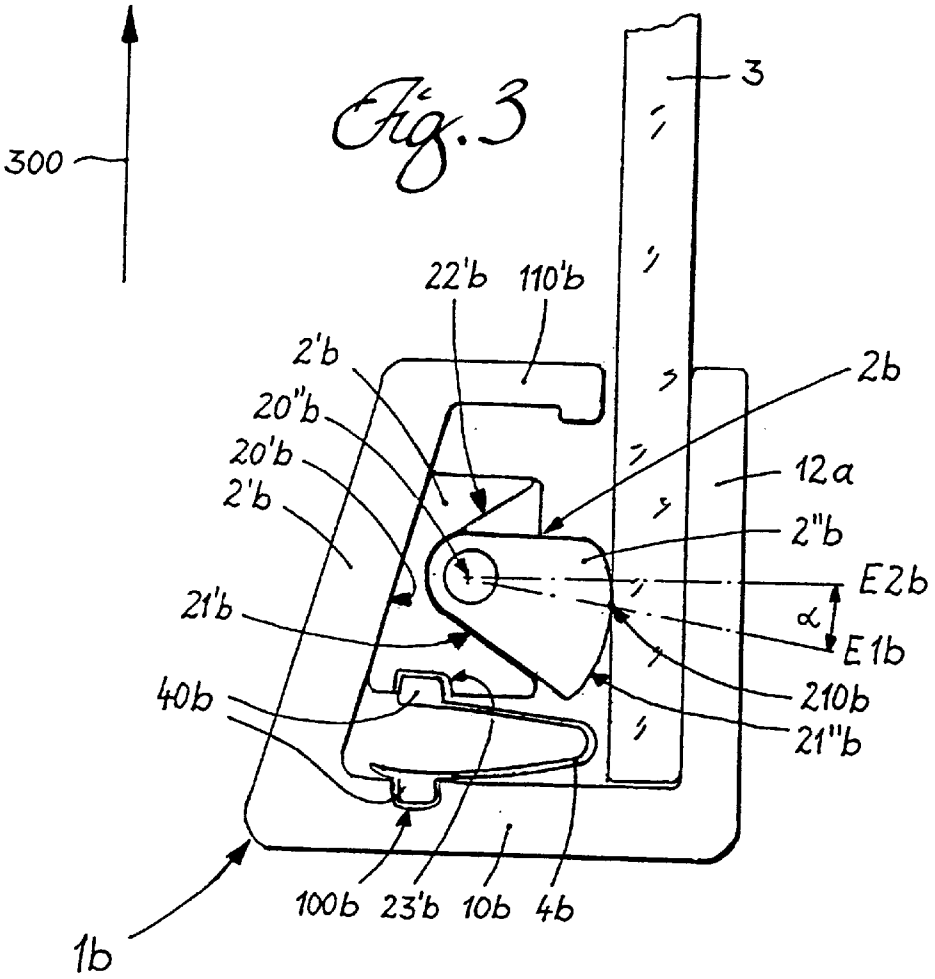
FIG. 3 is a diagrammatic view of the cross section through a fixing device with a wedge-shaped slider and a clamping body swivel mounted thereon.

With regard to the marginal conditions which are concerned with friction and which are necessary for reliable functioning of the fixing device, the same applies for the embodiments according to FIGS. 2 and 3 as for the embodiment already described in FIG. 1. The angle $\alpha$ between the plane E1*a* or E1*b* holding the clamping line 210*a*, 210*b* and the swivel axis 20*a*, 20*b* respectively, and the plane E2*a*, E2*b* running orthogonal to the plane of the pane should in turn meet the equation $$\alpha \leqq 2 \text{ arc tan } \mu \ (\mu\text{=friction value}).$$

The embodiment of FIG. 3 combines the technical features of FIGS. 1 and 2 since the locking element 2*b* is comprised of a slider 2'*b* supported on the inclined arm 11*b* and a swivel element (clamping member 2"*b* mounted thereon. The swivel element 2"*b* can be swivelled maximum between two stop faces 21'*b*, 22'*b* wherein its clamping line 210*b* formed with the clamping face 21"*b* on the window pane 3 always lies underneath the swivel axis 20"*b*. A leaf spring 4*b* is fixed inside the fixing device through molded detent elements 40*b*. The detent elements engage in recesses 23'*b* , 100*b* of the slider 2'*b* and base 10*b* and press the locking element 2*b* against the angled free end 110'*b* so long as the window pane 3 is still not inserted in the gap of the base member 1*b*. After insertion of the window pane 3, the sliding movement of the slider 2'*b* serves to compensate the manufacturing tolerances and the swivel movement of the swivel element 2"*b* serves to produce the clamping force (holding force for the window pane 3).

Figure 4:
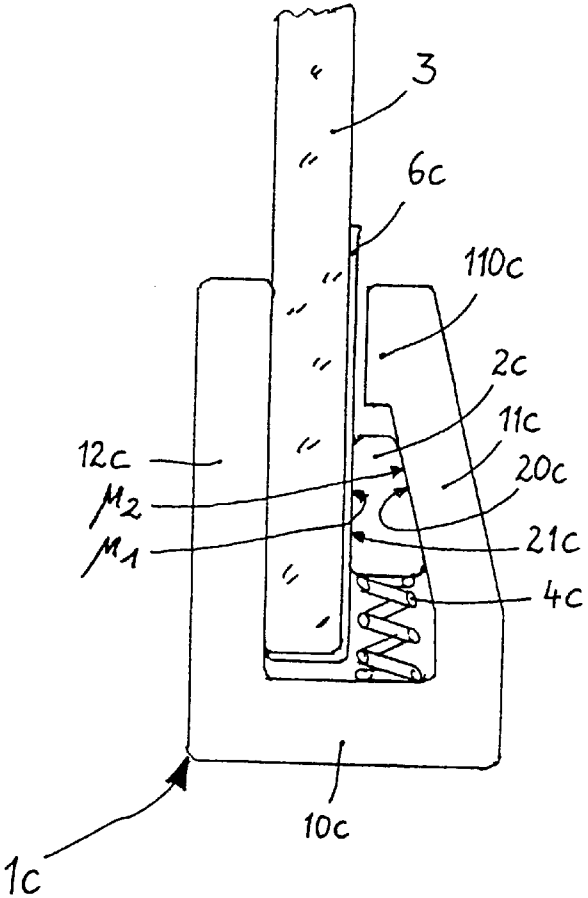
FIG. 4 is a diagrammatic view of the cross section through a fixing device with a locking element in the form of a clamping wedge and with an intermediate element.

FIG. 4 shows the cross section through a fixing device with a wedged locking element 2*c* which is pressed by a spring 4*c* into the conical gap formed by the inclined arm 11*c* and window pane 3. An intermediate element 6*c* is mounted between the window pane 3 and locking element 2*c* and produces with regard to the material of the locking element 2*c* improved friction conditions and reduces the surface pressure on the window pane 3.

Figure 5:
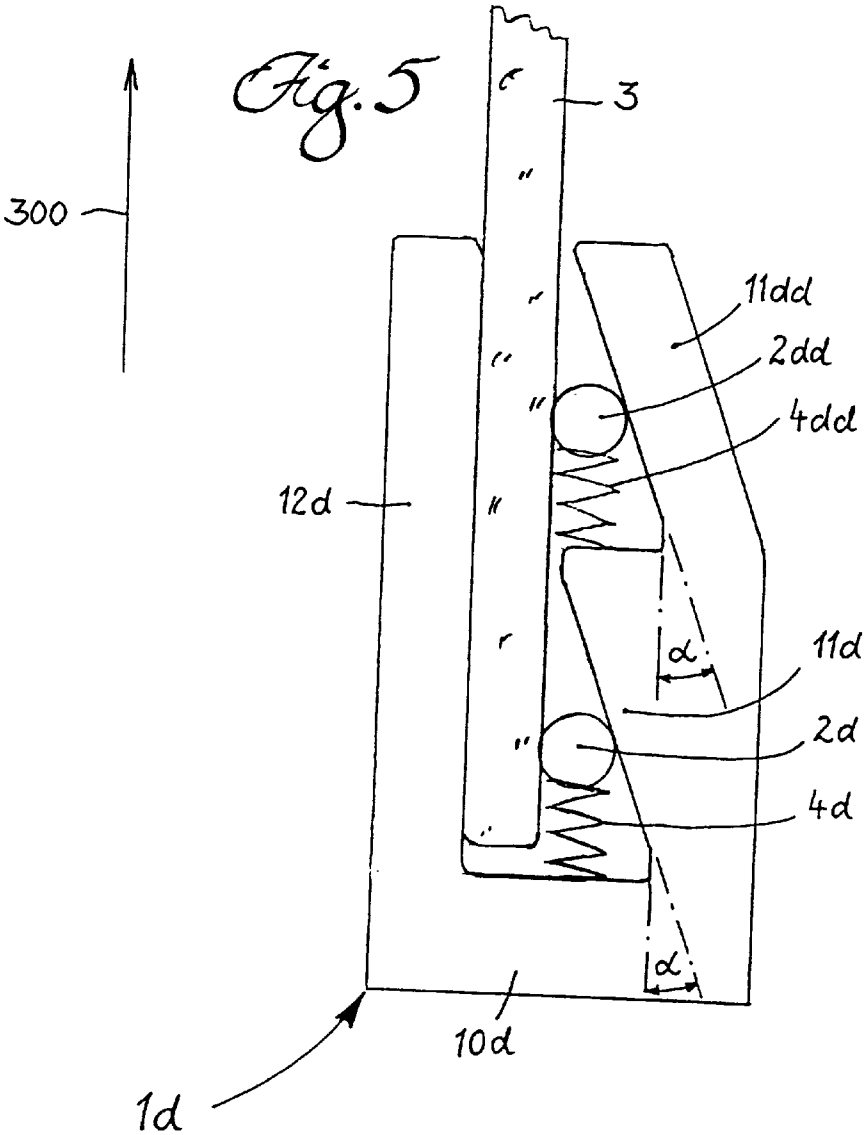
FIG. 5 is a diagrammatic view of the cross section through a fixing device with two conically aligned clamping faces and two associated cylindrical clamping bodies.

A further fixing device based on the friction-locking clamping principle is shown diagrammatically in FIG. 5. It has a base member 1*d* with a flat arm 12*d* for supporting the window pane 3 and with two opposite arms 11*d*, 11*dd* mounted in one piece one above the other, whose inner faces form a conical gap with the window pane 3. Cylindrical locking elements 2*d*, 2*dd* as well as the associated spring elements 4*d*,4*dd* which are supported on the base 10*d* and on the head of the arm 11*d*, respectively, are mounted in this gap.

With regard to the dimensions of the wedge angle $\alpha$ the same applies for the variation of FIG. 5 as for that described in FIGS. 1 to 3. Regarding the embodiment of FIG. 4 it happens that the friction value $\mu_1$ between the locking element 2*c* and intermediate element 6*c* must be greater than the friction value $\mu_2$ between the locking element 2*c* and arm 11*c*.

Figure 6:
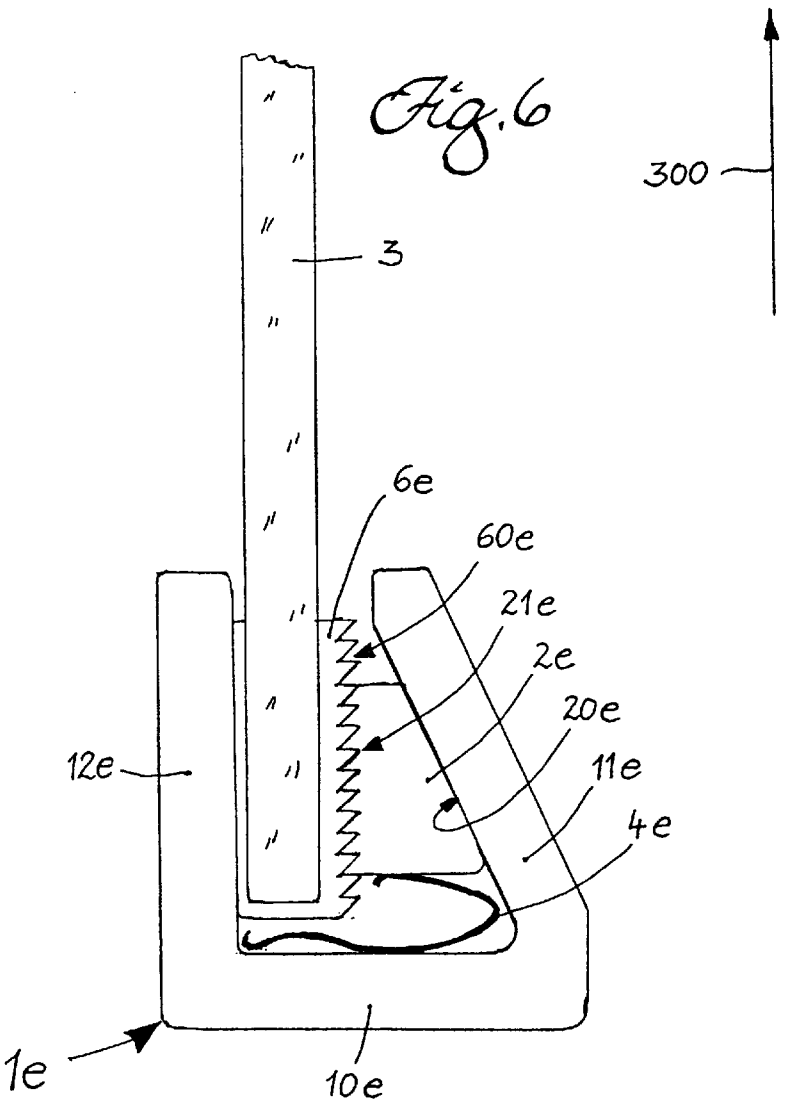
FIG. 6 is a diagrammatic view of the cross section through a fixing device with positive-locking elements on the intermediate element and on the locking element, wherein the locking element is wedge-shaped and is sprung in the withdrawal direction of the window pane.

FIG. 6 shows a variation of the invention with keyed locking of the window pane 3 using a wedged locking element 2*e* which is supported with its flat side face on the inclined arm 11*e* and whose opposite toothed surface engages with the positive-locking elements 21*e* into the positive-locking elements 60*e* of an intermediate element 6*e* fixed on the window pane 3. A leaf spring 4*e* is mounted between the base 10*e* of the base member 1*e* and the locking element 2*e* whereby the pretensioning force of the leaf spring presses the locking element 2*e* in the direction of the narrowing gap, i.e., in the withdrawal direction 300 of the window pane 3. The conical gap not only prevents, in the event of load on the window pane 3 on the withdrawal side, that the toothed elements 21*e*, 60*e* come out of engagement, but also ensures increasing clamping forces between the arms 11*e*, 12*e* which help to fix the pane.

Figure 7:
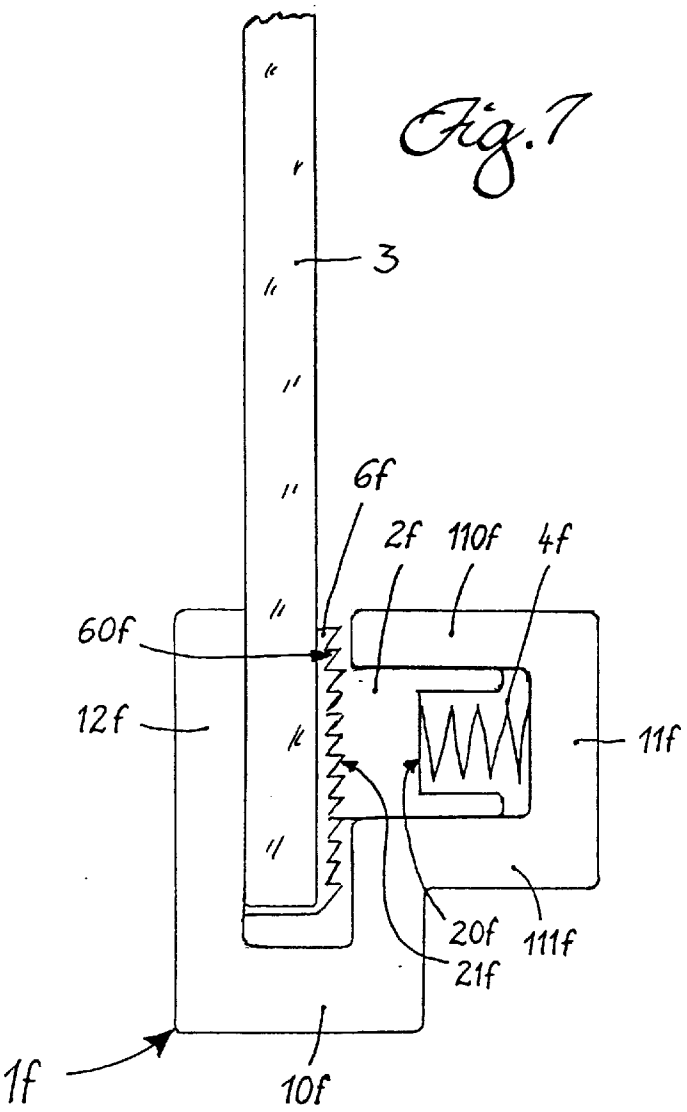
FIG. 7 is a diagrammatic view of the cross section through a fixing device with positive-locking elements on the intermediate element and on the locking element wherein the locking element is sprung across the plane of the disc.

It is slightly different with the variation shown in FIG. 7 since, as a result of the shape of the base member 1*f*, no self-increasing wedge actions can be used. The arms 110*f*, 111*f* angled towards the arm 11*f* guide the locking element 2*f* substantially orthogonal to the surface of the window pane 3. A coil spring 4*f* which is supported on one side on the arm 11*f* and on the other side on the locking element 2*f* presses its teeth 21*f* into the counter teeth 60*f* of the intermediate part 6*f* which is connected to the window pane 3.

Figure 8:
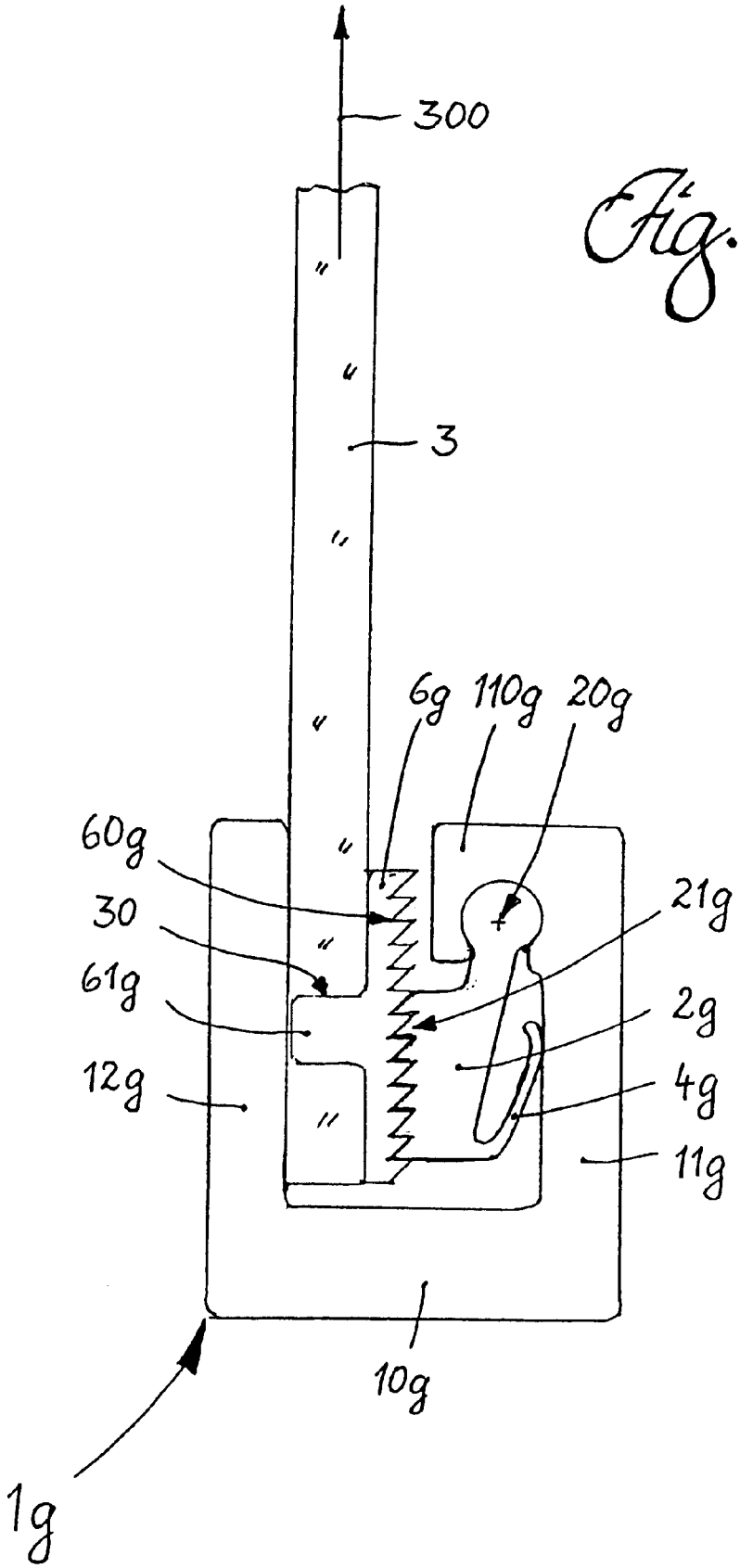
FIG. 8 is a diagrammatic illustration of the cross section through a fixing device with positive-locking elements on the intermediate element and on the locking element, wherein the locking element is swivel mounted on the arm of the base member and supports a spring element molded on in one piece.

A likewise positive-locking of the window pane 3 in the base member 1*g* of the fixing device is shown in the diagrammatic illustration of FIG. 8. The substantially U-shaped base member 1*g* supports, with its arm 12*g*, the window pane 3. On the opposite face of the pane there is an intermediate element 6*g* with positive-locking elements 60*g*. The intermediate element 6*g* supports on its back a stud 61*g* which is inserted in the pane hole 30. An articulated area for the articulated mounting of the locking element 2*g* is provided in the angled end 110*g* of the other arm 1*g*. The locking element 2*g* which is mounted to rotate about the swivel axis 20*g* has on its inside complementary positive-locking elements 21*g* which are pressed by a spring 4*g* molded integral on the back into the counter teeth 60*g* of the intermediate element 6*g*. The spring 4*g* is thereby supported on the inside of the arm 11*g*.

Figure 9:
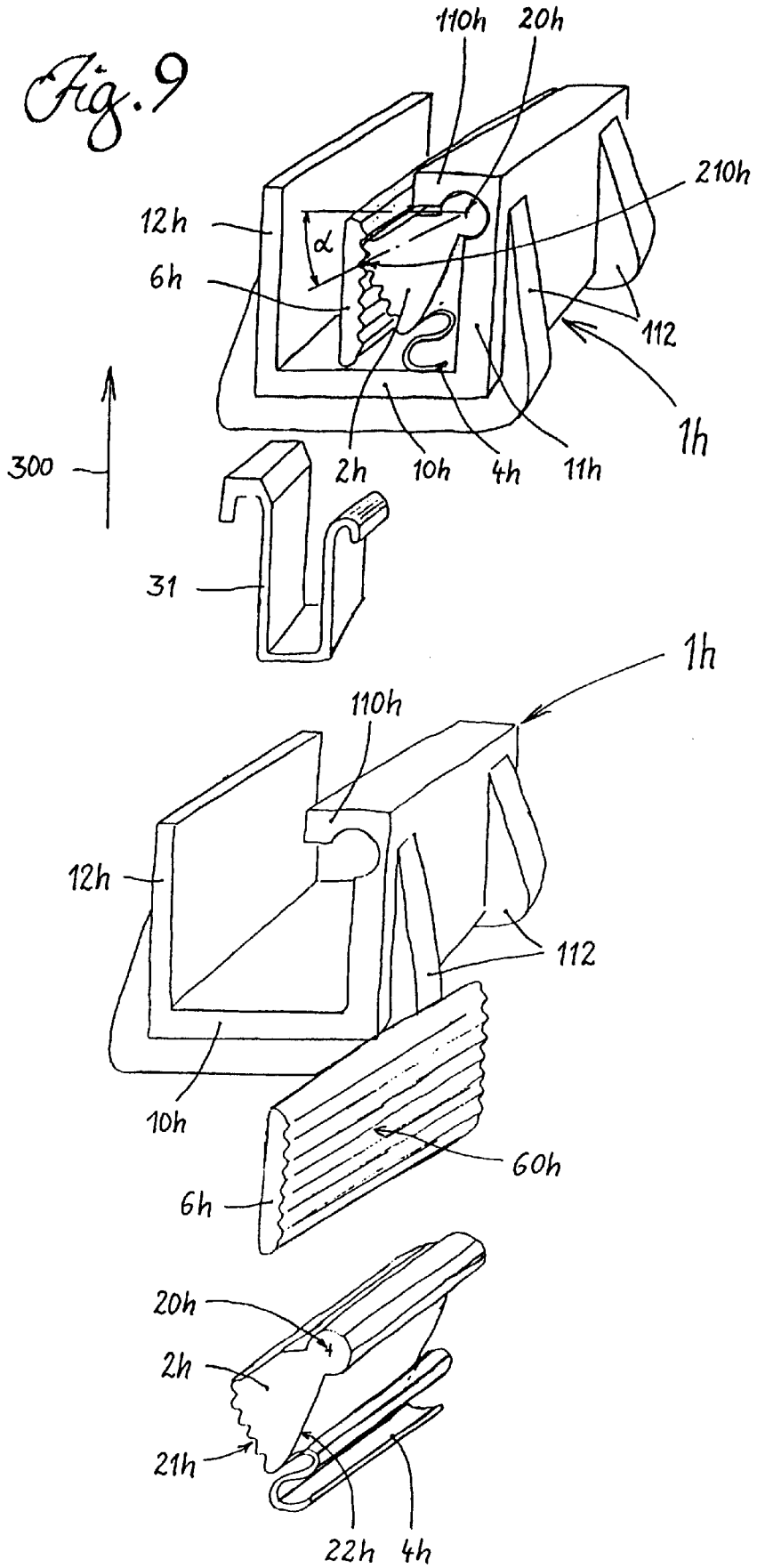
FIG. 9 is a diagrammatic perspective explosive view of a fixing device with a swivel clamping body and an inserted intermediate element.

The embodiment according to FIG. 9 relates to a structure which combines the friction locking and positive-locking fixing principles together. In order to take up the clamping forces the substantially U-shaped base member 1*h* is provided with reinforcement ribs 112. The fixing area of the (not shown) window pane is embraced by an insert 31 which should be made of rubber or an elastomer which is not too hard. The insert should produce the most favorable friction conditions possible in relation to the arm 12*h* and intermediate element 6*h*. It can also be injected directly onto the edge of the pane.

On the side remote from the window pane the intermediate element 6*h* has a wavy structure which produces positive-locking elements 60*h* to engage with complementary positive-locking elements 21*h* of the locking element 2*h*. On the upper end of the arm 11*h* is an articulated area with a swivel axis 20*h* in which the locking element 2*h* is mounted for restricted rotation. The swivel movement of the locking element 2*h* which is possible in the withdrawal direction 300 of the window pane is restricted by the angled arm 11*h* which acts as a stop. The locking element 2*h* is pretensioned in the direction of the window pane or intermediate element 6*h* by a spring 4*h* supported on the base 10*h* or on the arm 11*h*.

The (mean) contour of the clamping face 21*h* has an increasing distance, opposite the withdrawal direction 300 of the window pane, relative to the swivel axis 20*h* whereby during swivel movement of the locking element 2*h* the clamping force is increased. According to the design principle it is proposed that the clamping line 210*h* formed between the clamping face 21*h* and the intermediate element 6*h* lies underneath the swivel axis 110*h*. The plane formed by it with the swivel axis 20*h* is to include opposite the orthogonal to the plane of the pane an angle $\alpha$ which is at most twice as big as arc tan $\mu$ ($\mu$=friction value).

Figure 10:
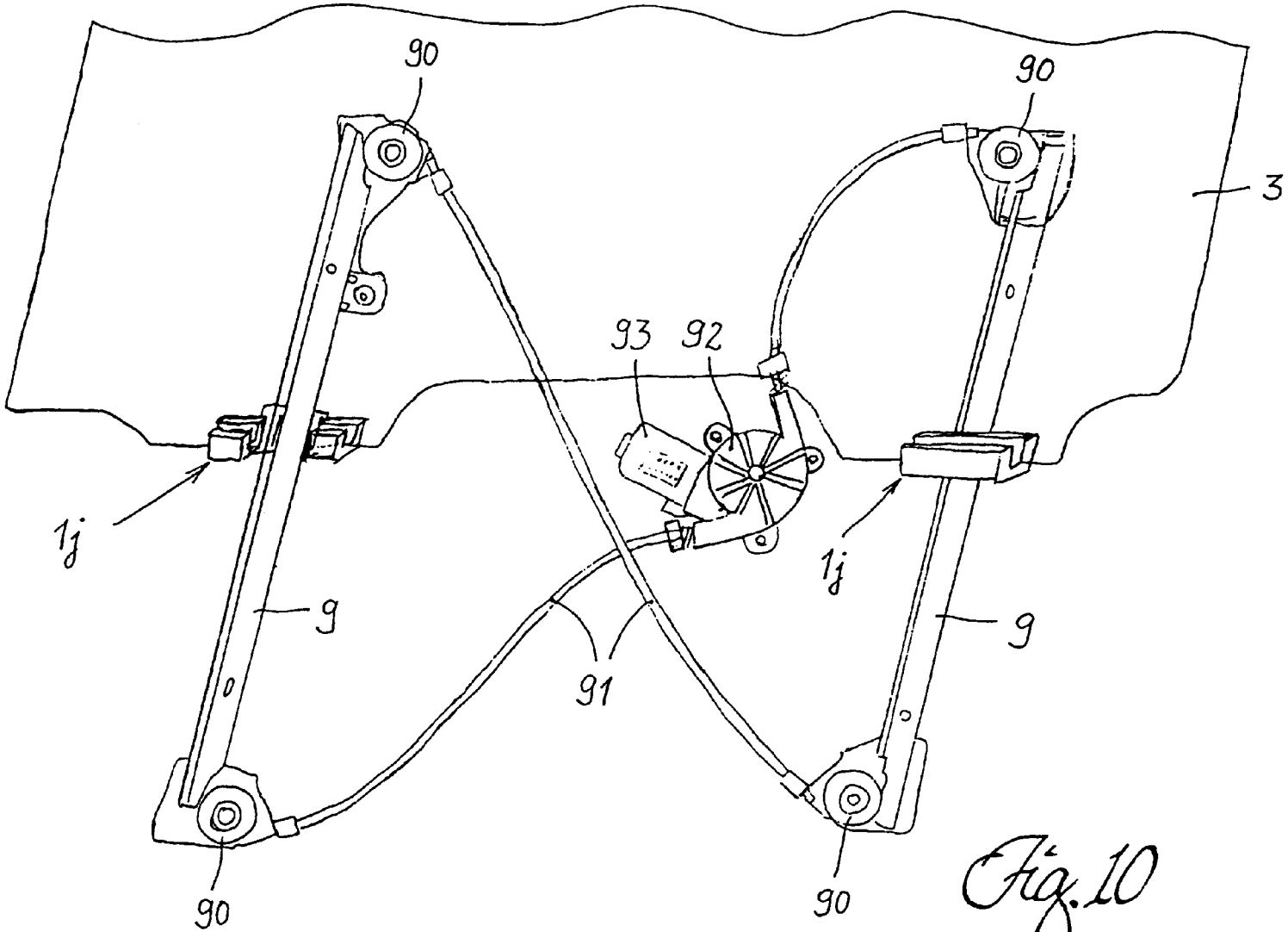
FIG. 10 is a diagrammatic view of a double-strand cable window regulator with a fixing device according to the invention.

In order to clarify the field of use of the variations of the invention previously described FIG. 10 shows only the principle structure of a double-strand cable window regulator. The base members 1*j* of the fixing device are a component part of the entrainment member of the window regulator and are mounted movable on the guide rails 9. The drive force required for the displacement is produced by a motor 93 and transferred through the gearing 92 to the closed cable loop which is guided over cable pulleys 90.

What is claimed is:

1. A device for fixing a movable window pane on a window regulator of a motor vehicle, comprising:

a substantially U-shaped base member having a base, and first and second side arms connected together through the base, the base member defining a gap to receive an edge area of the window pane, a locking element separate from and moveable relative to the base member; and a spring between the locking element and the base member;

wherein when the window pane is inserted in the gap of the base member, the locking element is supported on one side by the first side arm and on another side by a side face of the window pane, wherein the spring biases the locking element resiliently against at least one of an insert direction of the window pane and across a plane of the window pane when the window pane is inserted in the gap of the base member, and wherein movement of the locking element, carried out by the biasing force of the spring, at least one of reduces the gap of the base member and with the window pane inserted, increases the pressure of the locking element on the window pane.

2. The device according to claim 1 wherein the locking element has a support face adjacent the first side arm, and wherein the gap of the base member between the window pane, when the window pane is inserted in the gap of the base member, and the support face of the locking element is narrowed in a direction opposite the insert direction of the window pane.

3. The device according to claim 1 wherein the locking element is formed in one piece and is displaceable substantially parallel to the plane of the window pane.

4. The device according to one of the preceding claims, wherein the first side arm has an inner face, wherein the locking element is formed substantially as a rigid body and has a contact bearing face associated with the window pane, a flat contact bearing face parallel to the inner face of the first side arm of the base member, a release line along the contact bearing face associated with the window pane, and a release line along the flat contact bearing face parallel to the inner face of the first side arm of the base member, wherein the contact bearing face parallel to the inner face of the first side arm changes, in the direction opposite the insert direction of the window pane above the release line along the flat contact bearing face, into a first convex curved face, and that the locking element changes, on the contact bearing face associated with the window pane in the insert direction of the window pane underneath the release line along the contact bearing face associated with the window pane, into a second convex curved face, and wherein the release line along the flat contact bearing face lies above the release line along the contact bearing face associated with the window pane.

5. The device according to claim 4 wherein the locking element has a first plane defined by the two release lines, a second plane orthogonal to the window pane, a friction value, $\mu$, associated with at least one of the contact bearing faces of the locking element, a friction angle defined by $\zeta$=arc tan $\mu$, and a plane angle between the first plane defined by the two release lines and the second plane running orthogonal to the plane of the pane, wherein the plane angle is at most twice the friction angle.

6. The device according to claim 4 wherein the convex curved faces have a circular arc shaped contour.

7. The device according to claim 4 wherein the convex curved faces have a contour with changing diameter that changes as the distance from the release lines increase.

8. The device according to claim 4 further comprising a spring socket formed underneath the locking element in the shape of one of a stud and a recess, wherein the spring socket is connected to one end of the spring while another end of the spring is associated with the base of the base member.

9. The device according to claim 1 wherein the locking element has a slider and a clamping member swivel mounted on the slider, wherein the clamping member has a clamping face associated with the window pane, when the window pane is inserted in the gap of the base member, wherein the clamping face is curved convex and has a radius that increases in the insert direction of the window pane.

10. The device according to one of claims 1 and 2 wherein the locking element is formed in one piece and is swivel mounted on the first side arm of the base member.

11. The device according to claim 10 wherein the locking element has a clamping face associated with the window pane, when the window pane is inserted in the gap of the base member, wherein the clamping face is curved convex, and has a radius that increases in the insert direction of the window pane.

12. The device according to claim 11 wherein the clamping face is spring elastic.

13. The device according to claim 11, wherein the spring is connected to the locking element and is supported on the first side arm of the base member.

14. The device according to claim 9 wherein the clamping member has a swivel axis, and a clamping line between the clamping face and the window pane, wherein in a lowest position of the window pane, when the window pane is inserted in the gap of the base member, the clamping line formed between the clamping face lies below the swivel axis.

15. The device according to claim 14 wherein the locking element has a first plane defined by the clamping line and the swivel axis, a second plane orthogonal to the window pane, a friction value, $\mu$, between the clamping face and the pane, a friction angle defined by $\zeta$=arc tan $\mu$, and a plane angle between the first plane defined by the clamping line and the swivel axis, and the second plane running orthogonal to the plane of the pane, wherein the pane angle is at most twice the friction angle.

16. The device according to one of claims 1 to 3 wherein the locking element is wedge-shaped.

17. The device according to one of claims 1 to 3 wherein the locking element is cylindrical.

18. The device according to claim 1 further comprising an intermediate element mounted between the window pane and the locking element.

19. The device according to claim 18 wherein the locking element has positive-locking elements, wherein the intermediate element supports positive-locking elements associated with and complementary to the positive-locking elements of the locking element.

20. The device according to claim 19 wherein the positive-locking elements of at least one of the intermediate element and the locking element are sawtooth shaped.

21. The device according to one of claims 1, 2, 18 and 19 wherein the locking element is formed in one piece and is movable substantially across the plane of the window pane, wherein the locking element is pretensioned by the spring in a direction orthogonal to the window pane.

22. The device according to claim 1 wherein the locking element has a swivel movement carried out by the biasing force of the spring, which results in at least one of the gap of the base member reducing, and the pressure of the locking element on the window pane increasing when the window pane is inserted in the gap of the base member.

23. The device according to claim 13 wherein the spring is integral with the locking element and injection molded in a twin-component plastics technique.

24. The device according to claim 11 wherein the locking element has a swivel axis and a clamping line between the clamping race and the window pane, wherein in a lowest position of the window pane, when the window pane is inserted in the gap of the base member, the clamping line lies below the swivel axis of the locking element.

25. The device according to claim 24 wherein the locking element has a first plane defined by the clamping line and the swivel axis, a second plane orthogonal to the window pane, a friction value, $\mu$, between the clamping face and the pane, a friction angle defined by $\zeta$=arc tan $\mu$, and a plane angle between the first plane and the second plane, wherein the plane angle is at most twice the friction angle.

26. The device according to claim 18 wherein the intermediate element is in fixed connection with the window pane.

* * * * *